United States Patent [19]

Peterson

[11] 3,945,670

[45] Mar. 23, 1976

[54] DOOR EXIT FIXTURE WITH PNEUMATIC MEANS FOR MAINTAINING A LATCH BOLT IN ITS RETRACTED POSITION

[75] Inventor: Francis C. Peterson, St. Louis County, Mo.

[73] Assignee: C. Hager & Sons Hinge Manufacturing Company, St. Louis, Mo.

[22] Filed: July 29, 1974

[21] Appl. No.: 492,445

[52] U.S. Cl. ..... 292/92; 292/144

[51] Int. Cl.[2] ..... E05C 15/02

[58] Field of Search ..... 292/21, 92, 93, 144, 201; 70/92, 263, 264; 16/128, 67, 68

[56] References Cited

UNITED STATES PATENTS

| | | | |
|---|---|---|---|
| 2,571,379 | 10/1951 | Parsons | 49/167 |
| 3,481,076 | 12/1969 | Bedard | 292/144 X |
| 3,677,043 | 7/1972 | Cox | 70/92 |
| 3,722,938 | 3/1973 | Bauer | 292/92 |
| 3,767,238 | 10/1973 | Zawadzk | 292/21 |
| 3,801,144 | 4/1975 | Diehl | 292/92 |

FOREIGN PATENTS OR APPLICATIONS

| | | | |
|---|---|---|---|
| 1,183,003 | 3/1970 | United Kingdom | 292/92 |

*Primary Examiner*—Robert L. Wolfe
*Attorney, Agent, or Firm*—Gravely, Lieder & Woodruff

[57] ABSTRACT

An exit fixture for a door is connected with the lock on the door and includes manually operated means which when depressed retracts the bolt of the lock, thereby releasing the door. Springs act upon the manually operated means to restore the manually operated means to its original position wherein the bolt will again project from the door. A bellows or other pneumatic device when filled with pressurized air overcomes the force exerted by the springs so as to allow the manually operated means to assume the position in which the latch bolt is retracted, thus permitting the door to be opened and closed without operating the lock.

16 Claims, 4 Drawing Figures

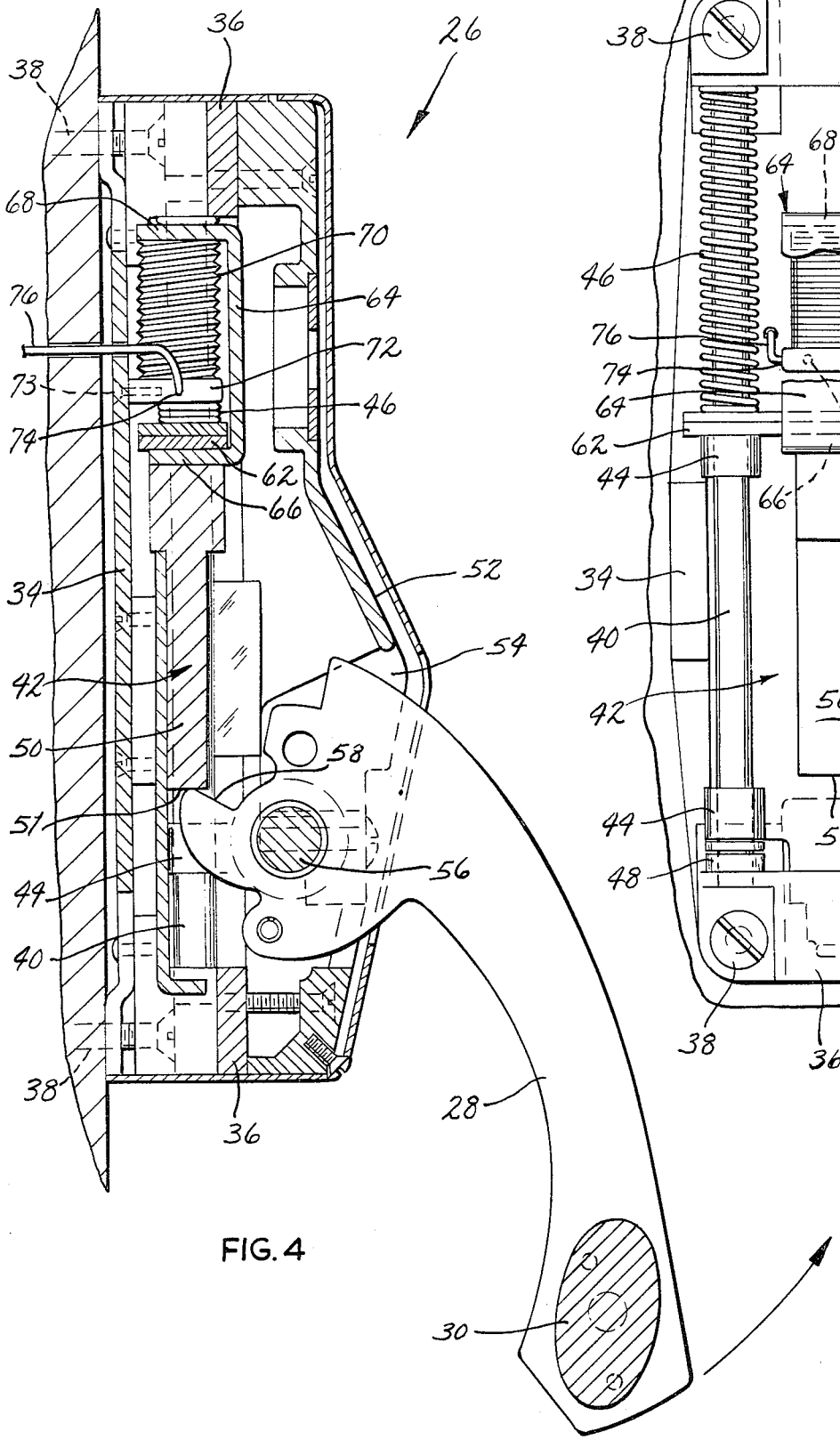
FIG. 4
FIG. 3
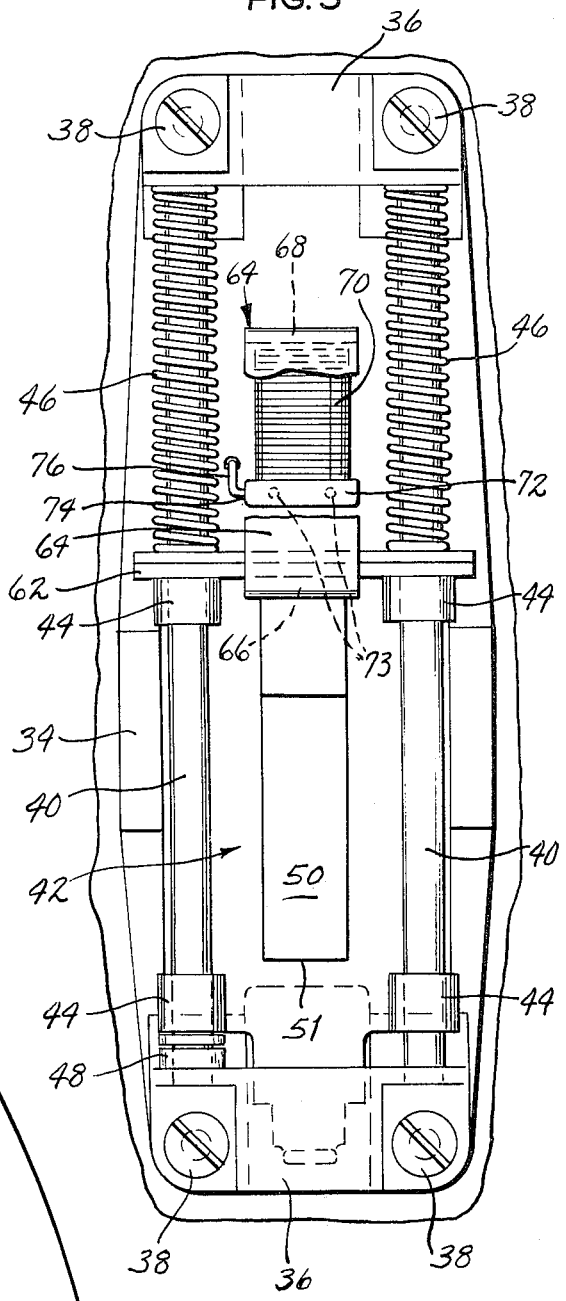

DOOR EXIT FIXTURE WITH PNEUMATIC MEANS FOR MAINTAINING A LATCH BOLT IN ITS RETRACTED POSITION

BACKGROUND OF THE INVENTION

This invention relates in general to apparatus for securing doors, and more particularly to an exit fixture for retaining a door bolt of a door lock in a retracted condition.

The exterior doors of some buildings are opened and closed many times each day, at least during business hours. For reasons of safety, these doors always open outwardly and are equipped with exit fixtures operable from the inside faces of such doors to retract the lock bolts. The typical exit fixture normally has a bar or paddle which is positioned slightly away from the inside face of the door and when pressed toward the door retracts the latch bolt. Thus, anyone pressed against the door in a panic situation will depress the cross bar or paddle and cause the door to swing open.

Since exit fixtures of the foregoing nature tend to wear out quite rapidly when installed on high use doors such as the exterior doors of schools and many public buildings, some of these exit fixtures are provided with dogging mechanisms for retaining the cross bar in a depressed condition and the latch bolt retracted. In that case, the door opens when merely pushed or pulled outwardly. A dogging mechanism of this nature is usually nothing more than a set screw which, when tightened, bears against one of the operating parts of the exit fixture such as the pivot arm to which the cross bar is connected, and thereby secures the arm and cross bar in a depressed condition. Setting and releasing these dogging mechanisms is a time consuming procedure and requires the presence of custodial personnel at the doors. Moreover, there is always the possibility that custodial personnel will forget to release the dogging mechanism on one of the doors after business hours, thereby permitting unauthorized entry into the building.

Heretofore attempts have been made to remotely control exit fixtures with electrically operated devices such as solenoids and motors, but the springs which hold the cross bar out are usually quite strong and to compress them requires considerable electrical energy. Indeed, the amount of energy required to compress such springs demands voltages and currents far in excess of that permitted in doors by most electrical codes.

SUMMARY OF THE INVENTION

One of the principal objects of the present invention is to provide means for retracting the latch bolt of a door lock from a remote location without running electrical lines into the door. Another object is to provide an exit fixture with the capability of pneumatically retracting a latch bolt against a substantial spring force. A further object is to provide a conventional exit fixture with a pneumatic actuating mechanism for retracting a latch bolt on the door in which the exit fixture is installed. These and other objects and advantages will become apparent hereinafter.

The present invention is embodied in an exit fixture for retracting a bolt in response to movement of manually operated means on the fixture. Restoring means are provided for returning the manually operated means to its original position and fluid operated means, when actuated, counteracts the restoring means so that the manually operated means remains in the position in which the bolt is retracted. The invention also consists in the parts and in the arrangements and combinations of parts hereinafter described and claimed.

DESCRIPTION OF THE DRAWINGS

In the accompanying drawings, which form part of the specification and wherein like numerals and letters refer to like parts wherever they occur:

FIG. 3 is a sectional view taken along lines 3—3 of FIG. 2; and

FIG. 4 is a sectional view similar to FIG. 2, but showing the bellows expanded and holding the slide in its elevated position.

DETAILED DESCRIPTION

Figures 1, 2:
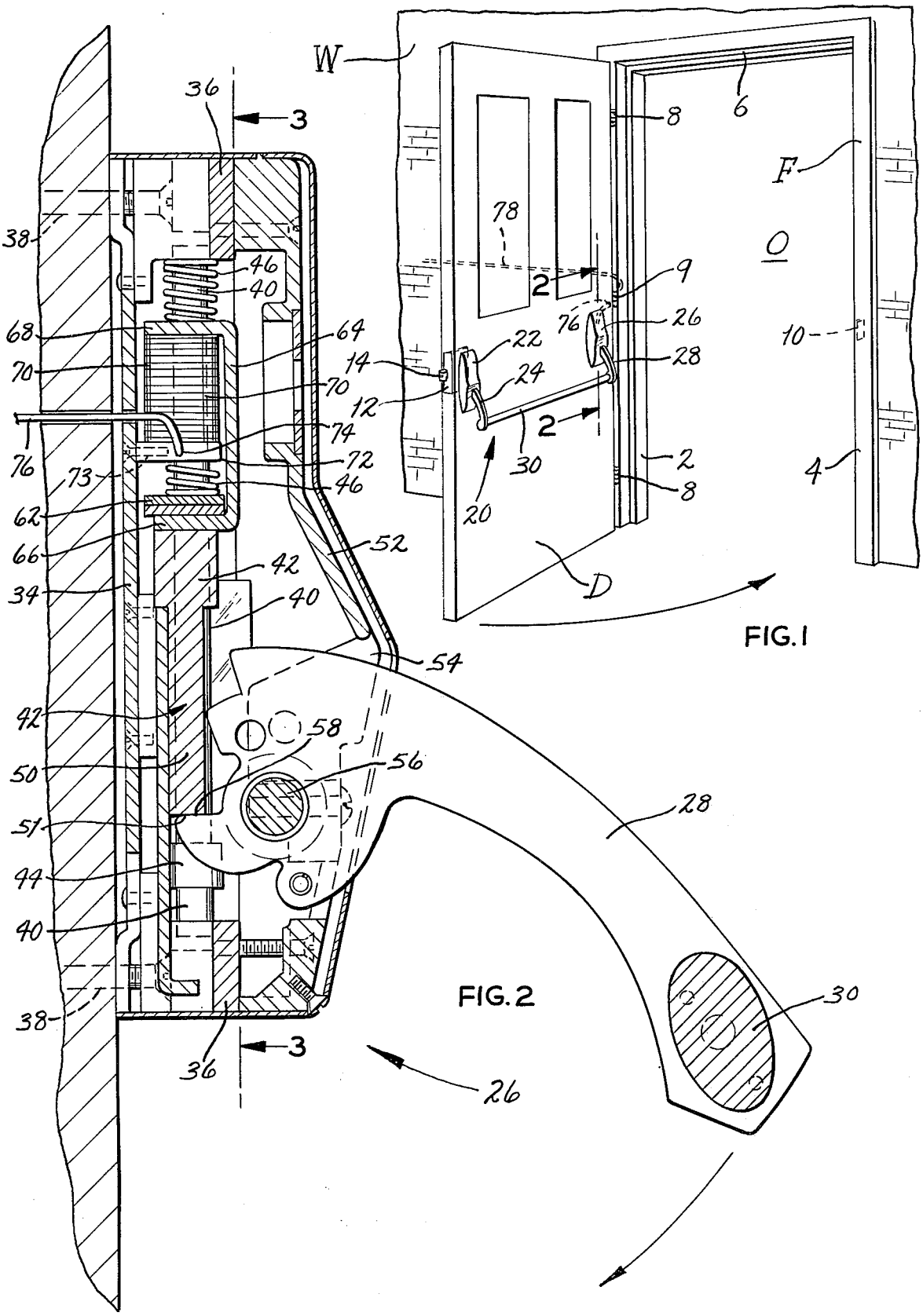
FIG. 1 is a perspective view of a door provided with an exit fixture constructed in accordance with and embodying the present invention.
FIG. 2 is a sectional view of the return unit for the exit fixture and taken along lines 2—2 of FIG. 1.

Referring now to the drawings (FIG. 1), an exterior wall W has a door opening O defined by a door frame F which is set into the wall W and includes a hinge jamb 2, a strike jamb 4 and a header 6 connecting the upper ends of the two jambs 2 and 4. The door opening O is normally closed by a door D which is supported on the hinge jamb 2 by a pair of conventional hinges 8 and also by a hinge 9 capable of transmitting pressurized air into the door D. Such a hinge is disclosed in U.S. patent application Ser. No. 461,096 of Francis C. Peterson, filed Apr. 15, 1974 and entitled HINGE CAPABLE OF TRANSMITTING PRESSURIZED AIR. The hinges 8 and 9 are attached to the door D such that the door D swings outwardly, that is to the outside of the building. The strike jamb 4 has a lock keeper or strike 10 set into it opposite the side edge of the door D when the door D is closed.

The door D carries a mortise type lock 12 (FIG. 1) which is recessed into the side edge of the door D and includes a retractable latch bolt 14 which normally projects beyond the side edge of the door D and extends into the strike 10 when the door D is closed, thereby securing the door D in its closed position. The exposed face of the latch bolt 14 is beveled so that the latch bolt 14 upon contacting the strike 10 as the door D closes is cammed inwardly. Of course, when the door D reaches its fully closed position, the latch bolt 14 aligns with and projects into the aperture in the strike 10 so the door D cannot be opened. The lock 12 also includes a relatively weak spring (not shown) for urging the latch bolt 14 to its extended position and a retracting mechanism (not shown) which when operated retracts the latch bolt 14. Since the lock 12 is conventional it will not be described in further detail.

Mounted on the inside face of the door D at about the level of the lock 12 is an exit fixture 20 (FIG. 1) for retracting the latch bolt 14 and thereby permitting the door to swing open. The exit fixture 20 includes an actuating unit 22 mounted on the door D adjacent to the lock 12, and this unit has a lever arm 24 pivoted therein. The lever arm 24 is connected with the retracting mechanism of the lock 12 and moves between extended and depressed positions. When the lever arm 24 is in its extended or elevated position, the latch bolt 14 is extended. However, as the lever arm 24 is depressed toward the inside face of the door D the latch bolt 12 is retracted.

In addition, the exit fixture 20 includes a spring return unit 26 (FIG. 1) which is likewise mounted on the inside face of the door D, but on the opposite side of the door D from the actuating unit 22. the return unit 26 has a pivot lever arm 28 and otherwise appears identical to the actuating unit 22. However, the lever arm 28 is not connected to the lock 12, but instead is spring loaded so that it is always urged to its extended position. Extending between the two actuating arms 24 and 28 of the units 22 and 26, respectively is a cross bar 30 which is sometimes referred to as a panic bar. The bar 30 is positioned away from the back face of the door D and couples the two lever arms 24 and 28 so that they move un unison between their extended and retracted positions. This enables the lever arm 28 of the return unit 26 to move the lever arm 22 of the actuating unit 22 back to its outermost position when the cross bar 30 is not held in its depressed position.

The lock 12, actuating unit 22, and cross bar 30 are conventional to exit fixtures of current design and manufacture. The return unit 26 differs from conventional spring return units in that it is provided with a pneumatic mechanism to counteract the force of the spring therein and thereby permit the lever arms 24 and 28 to remain in the depressed position. The lever arms of conventional spring return units have set screws which are tightened to achieve this end.

The spring return unit 18 includes (FIGS. 2–4) an elongated base plate 34 having end fittings 36 riveted to the ends thereof. The base plate 34 is mounted on the door D adjacent to the hinge jamb 2 with its longitudinal axis extended vertically, the plate 34 being secured by screws 38 which extend through the end fittings 36 and thread into the door D. Extended between the end fittings 36 in the vertical direction are parallel guide rods 40 (FIG. 3) on which a slide 42 is mounted with the rods 40 forming a track for the slide 42. The main body of the slide 42 is actually positioned between the base plate and the guide rods 40, but the slide 42 is provided with guide shoes 44 which bend around the rods 40 and retain the slide 42 on them. The slide 42 is urged toward the lower end fittings 38 by coil springs 46 which encircle the upper portions of the guide rods 40 and bear against the upper end of the slide 42. One of the guide rods 40 has a stop collar 48 (FIG. 3) surrounding it to limit the downward movement of the slide 42. At its center the slide 42 is provided with an outwardly projecting drive block 50 which terminates at a downwardly presented shoulder 51.

The lever arm 28 for the return unit 26 is mounted on a covering member 52 (FIGS. 2 and 4) which is fastened to the end fittings 38 by screws. The covering member 52 has an elongated aperture 54 located outwardly from the slide 42 and carries a horizontal pin 56 which spans the aperture 54 parallel to the base plate 34. The lever arm 28 projects through the aperture 54 and the pin 56 serves as a journal for it. The lever arm 28 has a drive shoulder 58 which lies against the downwardly presented shoulder 51 of the drive block 50 on the slide 42. Thus, when the exposed portion of the lever arm 30 is depressed toward the door D, the shoulder 58 swings upwardly in an arc and, being in contact with the slide 42 at the drive block 50 thereon, moves the entire slide 42 upwardly against the force exerted by the springs 46.

The foregoing components of the return unit 26 are conventional, as are the cross bar 30, the actuating unit 22 and and lock 12.

Aside from its conventional components, the slide 42 of the return unit 26 is further fitted with a cross member 62 (FIGS. 2–4) which extends between the upper guide shoes 44 and is forced against those shoes by the springs 46 (FIG. 3). Attached to the midportion of the cross member 62 and exended upwardly therefrom is a U-shaped bracket 64 having a lower tab 66 which underlies the cross member 62 and an upper tab 68 which projects rearwardly toward the base plate 44. The tabs 66 and 68 of the bracket 64 are centered between the two guide rods 40, with the latter being located directly above the former. The space between the upper and lower tabs 66 and 68 is occupied for the most part by a metal bellows 70 having a closed upper end and a rectangular base 72 at its lower end. The axis of the bellows 70 is vertical and is centered between the guide rods 40 as well as with respect to the upper tab 68. The close upper end of the bellows 70 bears against the underside of the upper tab 68 for the bracket 64. The rectangular base 72 has substantial thickness and is secured firmly to the base plate 34 by machine screws 73 (FIGS. 2 and 4) which extend through the base plate 34 and thread into the base 72 from the back edge thereof.

The base 72 has an entry port 74 which communicates with the interior of the bellows 70 and is connected with a flexible air line 76 extended through the door D to the hinge 9. The air line 76 is connected through the hinge 9 to another flexible air line 78 (FIG. 1) extended through the wall W, and this line extends between the hinge 9 and a solenoid valve (not shown) which is connected with a source of high pressure air. When the solenoid valve is energized, the air lines 78, 76 and the interior of the bellows 70 are placed in communication with the source of high pressure air and as a result the bellows 70 will expand. However, when the solenoid valve is de-energized, the lines 78 and 76 and the interior of the bellows are vented through the valve and this enables the bellows 70 to contract. The diameter of the bellows 70 and the pressure of the air supplied to it through the valve are such that the axial force exerted by the bellows 70 on the connecting member 66 is great enough to overcome the force of the springs 46 and move the slide 42 upwardly. The weight of the lever arms 24 and 28 and the cross bar 30 connecting them is enough to overcome the relatively weak spring force exerted on the latch bolt 14, so the latch bolt 14 remains retracted.

In lieu of the hinge 9, the two air lines 76 and 78 may be connected through a flexible hose which bridges the gap between the door D and the hinge jamb 2. Also, the bellows 70 may be replaced with some other type of pneumatic mechanism such as an air cylinder. In that case, the barrel of the cylinder would be secured to the base plate 34 and the piston rod to the tab 68, or viceversa.

In some exit fixtures the actuating and return units 22 and 26 are integrated into a single housing. A paddle operated exit fixture is an example of such an exit fixture. The bellows 70 may be utilized in such exit fixtures also in a similar manner.

OPERATION

During periods of low use, such as after business hours, the solenoid valve is not energized, and in that condition vents the air lines 78, 76 and the interior of the bellows 70. As a result, the bellows 70 is free to contract, which it does, and the springs 46 of the return unit 26 hold the slide 42 downwardly in its lowermost position, that is the position in which one of the lower guide shoes 44 bears against the stop collar 48 (FIGS. 2 and 3). The slide 42 in turn holds the lever arm 28 of the spring return unit 26 upwardly, and since the lever arm 28 is connected to the lever arm 24 of the actuating unit 22 through the cross bar 30, the lever arm 24 is likewise raised. As a result, the latch bolt 14 projects from the side edge of the door D and engages the strike 10, when the door is fully closed so as to secure the door D in the closed position.

One desiring to exit the building through the door opening O when the solenoid valve is not energized, need only depress the cross bar 30 toward the door D in order to release the door D. In particular, when the cross bar 30 is depressed, both lever arms 24 and 28 swing downwardly toward the inside face of the door D. The lever arm 24 of the actuating unit 22 moves the retracting mechanism of the lock 12 which in turn retracts the latch bolt 14 to release the door D from the strike 10. The lever arm 28 of the return unit 26, on the other hand, raises the slide 42 which in turn compresses the springs 46. Once the cross bar 30 is released, the springs 46 drive the slide 42 downwardly which elevates both lever arms 28 and 24 so that the latch bolt 14 again projects from the edge of the door D. As the door D closes the beveled face on the latch bolt 14 contacts the strike 10 and the entire latch bolt 14 is cammed inwardly until the door D reaches its fully closed position, at which time the latch bolt 14 projects into the aperture of the strike 10 and secures the door D.

When the solenoid valve 80 is energized, air from the high pressure source is directed into the line 78 and as a result the pressure within the line 76 and the interior of the bellows 70 increases. The bellows 70 expand and move the U-shaped connecting member 64 upwardly (FIG. 4). Since the slide 42 is attached to the connecting member 64, it also moves upwardly and compresses the springs 46 still further. Indeed, the bellows 70 forces the slide 42 to its uppermost position. The lever arms 24 and 28 drop downwardly under their own weight and the weight of the cross bar 30, and the combined weight of these components is enough to overcome the relatively weak spring force on the latch bolt 14. In other words, the lever arm 24 of the actuating unit 22 moves the retracting mechanism of the lock 12 which in turn retracts the latch bolt 14. As a result, the latch bolt is retracted when the solenoid valve 80 is energized and the door D is free to swing open without actuating the lock 12.

This invention is intended to cover all changes and modifications of the example of the invention herein chosen for purposes of the disclosure which do not constitute departures from the spirit and scope of the invention.

I claim:

1. In a door mounted in a framing structure for movement between open and closed positions and having a lock provided with a retractable latch bolt which is spring biased outwardly to an extended position where it will engage the framing structure and secure the door in its closed position, an improved exit fixture mounted on the door for retracting the latch bolt and comprising: a base mounted in a fixed position on one face of the door; a slide mounted on the base such that it is capable of moving in the vertical direction with respect to the door, the slide being coupled with the latch bolt such that when the slide is moved in one direction the latch bolt is retracted against the spring biasing force exerted thereon and when the slide is moved in the opposite direction the latch bolt is permitted to extend under the spring biasing force thereon, the coupling between the latch bolt and the slide further being such that when the slide is positioned in said opposite direction the latch bolt may be retracted by an external force without moving the slide; a spring acting on the slide and urging it in said opposite direction; a lever mounted for rotational mvoement about a horizontal pivot axis fixed with respect to the base, the lever acting upon the slide such that a manual force applied to the lever in the direction which moves the lever toward said one face of the door will cause the slide to move in said one direction against the force exerted thereon by the spring; and fluid operated force exerting means on the base for also urging the slide in said one direction, the fluid operated force exerting means when connected with and pressurized by a source of pressurized fluid being capable of expanding and overcoming the force exerted on the slide by the spring so that the slide is moved in said one direction and held in a fixed position for so long as pressurized fluid is admitted to the force exerting means, whereby the latch bolt is retracted when the lever is manually moved or when the fluid operated means is pressurized.

2. The structure according to claim 1 and further comprising a base along which the slide moves and wherein the fluid operated means comprises a bellows having one end fixed in position on the base and its opposite end connected with the slide.

3. The structure according to claim 1 wherein the source of pressurized fluid is located remote from the door and the fluid operated force exerting means is connected to the source of pressurized fluid through a fluid line in the door and through a hinge on which the door is mounted on the framing structure.

4. The structure according to claim 1 wherein force exerting means expands and contracts along an axis parallel to the path of the slide.

5. The structure according to claim 4 wherein the force exerting means is located directly beyond one end of the slide, and the slide moves toward and away from the force exerting means.

6. The structure according to claim 5 wherein the force exerting means has two ends and is attached to the base at the end thereof presented toward the slide; and wherein a connecting member connects the opposite end of the force exerting means to the slide.

7. The structure according to claim 6 wherein the force exerting means is a bellows and the connecting member is generally U-shaped, having tabs at both ends, the tab at one end being engaged with the slide and the tab at the opposite end extending across said opposite end of the bellows.

8. The structure according to claim 7 and further comprising a pair of guides along which the slide moves, and wherein the bellows is between the two guides.

9. The structure according to claim 8 wherein the spring is one of two springs which encircle the guides and are maintained in a state of compression.

10. The structure according to claim 8 wherein the slide has a cross member at the end thereof presented toward the bellows and the tab at said one end of the connecting member bears against the cross piece when the bellows is pressurized.

11. The structure according to claim 1 wherein the lever is one of several elements which couple the slide with the retractable latch bolt.

12. The structure according to claim 11 wherein said several elements include another lever mounted for rotational movement about the horizontal axis and a cross bar connecting the two levers so that the levers move in unison; and wherein the torque about the horizontal axis created by the weight of the levers and the cross bar is sufficiently great to maintain the latch bolt retracted against the biasing force thereon when the slide is positioned in said one direction by the fluid operated force exerting means.

13. In a door mounted in a framing structure for swinging movement between open and closed positions and having a retractable latch bolt which is spring biased outwardly for engagement with the framing structure wherein it secures the door in its closed position, an exit fixture for operating the latch bolt, said exit fixture comprising: a base secured firmly to that face of the door presented away from the direction in which the door opens; a vertical guide track on the base; a slide mounted on the guide track for vertical movement along the track; the slide being coupled with the latch bolt such that when the slide is moved upwardly the latch bolt is retracted against the spring biasing force thereon and when the slide is moved downwardly the latch bolt is permitted to extend, the slide being coupled with the latch bolt such that when the slide is positioned downwardly the latch bolt may be retracted by the application of an external force thereto; a compression spring having one end fixed with respect to the base and the other end bearing against the slide such that the slide is urged downwardly; a lever pivoted about a horizontal axis which is fixed in position with respect to the base and is located generally outwardly from the slide so that the slide is between said one face of the door and the horizontal axis, the lever having a free end and a driving end with the ends being located on opposite sides of the horizontal axis, the driving end being positioned against the slide such that when the free end of the lever is depressed downwardly and toward the door, the slide is urged upwardly against the force exerted thereon by the spring; and an air bellows located adjacent to the slide and having one end fixed with respect to the base and its other end connected with the slide such that when the bellows expands as the result of the introduction of pressurized air into it the slide will also be urged upwardly against the force exerted by the spring, whereby the latch bolt is retracted when the lever is depressed or when the bellows is pressurized.

14. The structure according to claim 13 wherein the lower end of the bellows is mounted firmly on and fixed with respect to the base and a connecting member being engaged with the slide so that when the bellows expand, the connecting member will rise and elevate the slide.

15. The structure according to claim 14 wherein the track comprises a pair of parallel rods extended through the slide; wherein the spring is one of two springs encircling the rods; and wherein the bellows is located between the rods.

16. The structure according to claim 15 wherein the bellows is pressurized by a source of pressurized air located remote from the door and the remote source of pressurized air communicates with the bellows through a hinge by which the door is mounted on the framing structure.

* * * * *